US007770709B2

(12) United States Patent
Matsuura et al.

(10) Patent No.: US 7,770,709 B2
(45) Date of Patent: Aug. 10, 2010

(54) BILL DISCRIMINATING AND COUNTING APPARATUS

(75) Inventors: Shinji Matsuura, Himeji (JP); Toshio Numata, Himeji (JP); Hajime Morino, Himeji (JP); Shinji Matsui, Himeji (JP)

(73) Assignee: Glory, Ltd., Hyogo (JP)

( * ) Notice: Subject to any disclaimer, the term of this patent is extended or adjusted under 35 U.S.C. 154(b) by 589 days.

(21) Appl. No.: 11/664,997

(22) PCT Filed: Oct. 12, 2004

(86) PCT No.: PCT/JP2004/015343

§ 371 (c)(1),
(2), (4) Date: Apr. 10, 2007

(87) PCT Pub. No.: WO2006/040835

PCT Pub. Date: Apr. 20, 2006

(65) Prior Publication Data

US 2009/0014277 A1 Jan. 15, 2009

(51) Int. Cl.
*G07F 7/04* (2006.01)

(52) U.S. Cl. ..... 194/206

(58) Field of Classification Search ..... 194/200, 194/206; 902/16

See application file for complete search history.

(56) References Cited

U.S. PATENT DOCUMENTS 6,695,119 B2 * 2/2004 Yamamoto ..... 194/206

FOREIGN PATENT DOCUMENTS

| | | | |
|---|---|---|---|
| JP | 63-269270 | A | 11/1988 |
| JP | 5-108844 | A | 4/1993 |
| JP | 2003-296801 | A | 10/2003 |

* cited by examiner

*Primary Examiner*—John Q. Nguyen
*Assistant Examiner*—Mark Beauchaine
(74) *Attorney, Agent, or Firm*—Sughrue Mion, PLLC

(57) ABSTRACT

According to the present invention, pieces of data of states of sensors and actuators in a bill discriminating and counting apparatus are stored in a ring memory at constant time intervals, among these stored data, both the data involved in an error are associated with the error events and stored in a non-volatile memory or a hard disk when the error is occurred in the bill discriminating and counting apparatus, and then the data is read from the non-volatile memory or hard disk to analyze the error. Specifically, digital port input and output information (states of sensors and actuators), analog sensor voltage, and analog motor current value are stored in a memory at constant time intervals since the power is turned on or the counting is started, and the stored port information and voltage are stored in the non-volatile memory or the like along with contents of abnormality when the abnormality is occurred.

5 Claims, 7 Drawing Sheets

FIG.5
(A) NORMAL CASE
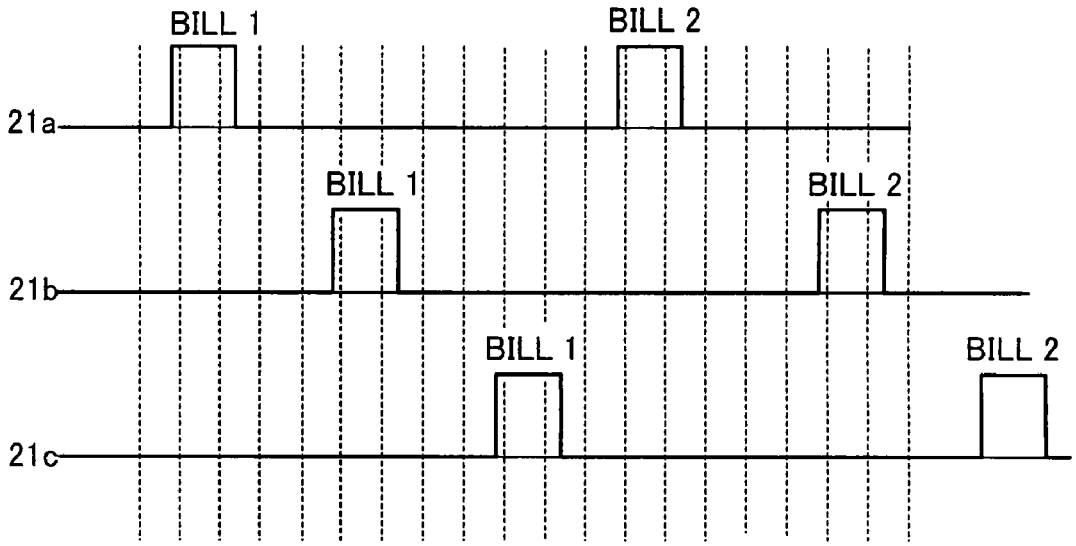
(B) JAM ERROR
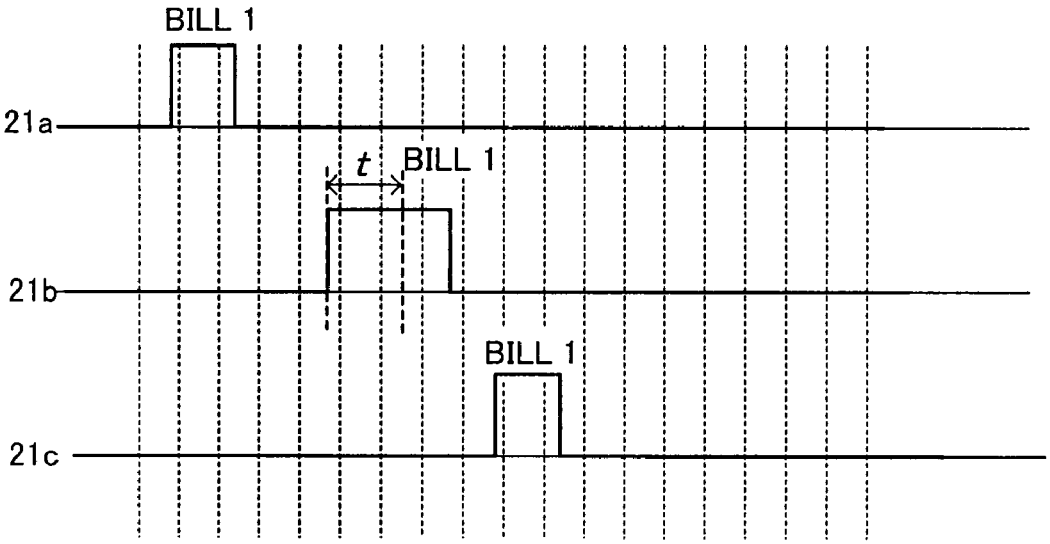

FIG.6

| Error event | Error code | Obtained data |
|---|---|---|
| Jam | 05−01 | Port data 1 (sensor 21a-R)<br>Port data 2 (sensor 21a-L)<br>Port data 3 (sensor 21b-R)<br>Port data 4 (sensor 21b-L)<br>Port data 5 (sensor 21c-R)<br>Port data 6 (sensor 21c-L)<br>Port data 7 (branching position detection sensor 12)<br>Port data 11 (dividing solenoid output)<br>A/D input (motor current value) |
| Number discrepancy | 03−01 | Port data 1 (sensor 21a-R)<br>Port data 2 (sensor 21a-L)<br>Port data 3 (sensor 21b-R)<br>Port data 4 (sensor 21b-L)<br>Port data 5 (sensor 21c-R)<br>Port data 6 (sensor 21c-L) |

FIG.7
(A) DIGITAL DATA
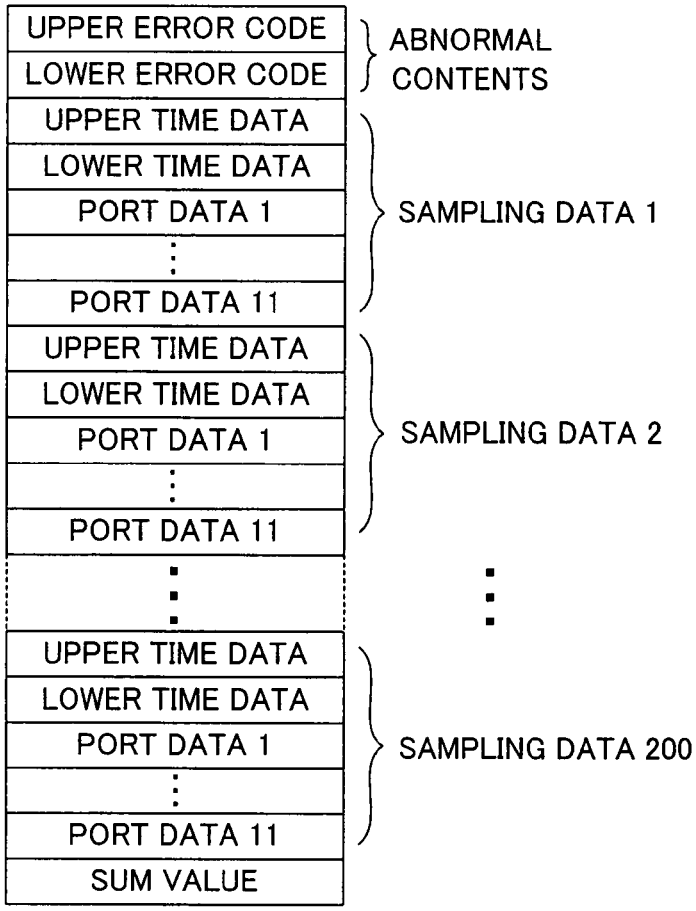
(B) ANALOG DATA
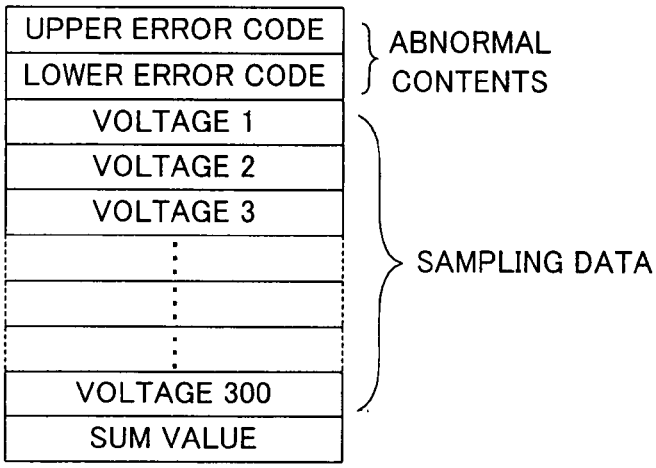

BILL DISCRIMINATING AND COUNTING APPARATUS

TECHNICAL FIELD

The present invention relates to a bill discriminating and counting apparatus which discriminates a denomination of a bill received through a hopper while counting a total amount of the received bills or the number of bills in each denomination, particularly to the bill discriminating and counting apparatus which has a function of logging various pieces of potential data, involved in an error, as being associated with an error event when the error is occurred.

BACKGROUND ART

There is a well known bill discriminating and counting apparatus, in which bills having mixed denominations are collectively received from a hopper, the bills are fed and carried one by one, the bills are counted while the denomination and authenticity of the bills are discriminated, and the total amount of the normal bill or the number of bills in each denomination is counted and displayed (for example, see Japanese Patent Application Laid-Open No. 2003-296801).

A structure and an operation of a conventional bill discriminating and counting apparatus will be described with reference to FIG. 1. FIG. 1 is a longitudinal cross-sectional view showing an internal structure of the conventional bill discriminating and counting apparatus.

A feeding roller 5 feeds the bill placed in a hopper 1 into a transport path of the bill discriminating and counting apparatus, and the bill is carried by plural carrying rollers 6.

During the bill carrying, the bill passes through detection sensors 7*a* and 7*b*, and a bill discriminating sensor 8 discriminates the denomination and authenticity. Then, the bill passes through a detection sensor 7*c*, and the bill is received between blades of a rotating impeller 9 when the bill is normal and the bill is aligned and collected in a stacker 2. On the other hand, when the bill discriminating sensor judges that the bill is a forged bill, a solenoid 10 is operated to move a branching pawl 11 downward, and the bill is delivered to a rejection section 3. A branching position detection sensor 12 detects whether or not the branching pawl is actually operated even if the solenoid 10 is turned on. The numeral 4 designates an operation and display section which performs various settings in performing the bill discriminating and counting process and displays the counted total amount and the like.

In the bill discriminating and counting apparatus, when the bill fed from the hopper 1 is jammed in the transport path by some sort of reason, output of one of the detection sensors 7*a* to 7*c* becomes abnormal, the bill discriminating and counting apparatus is disabled in the following operations, and the apparatus is stopped. Even if the bill is not actually jammed, sometimes the apparatus judges that the jam is occurred due to abnormality of the detection sensor itself (this is called "fake jam").

Furthermore, sometimes there is occurred a problem that the apparatus recognizes the two bills as one bill because an interval of the two bills is narrowed and overlapped at some point, although the apparatus initially recognizes the two bills. The problem is called "number discrepancy". It is judged when the numbers of times the bill passes through the detection sensors 7*a* to 7*c* are not matched with one another.

In such cases, the trouble is solved by removing the jammed bill or by pressing a reset button to start all over again. From the standpoint of recurrence prevention, it is necessary to trace the cause to perform necessary maintenance.

In this case, an operator who uses the bill counting apparatus does not perform the actual maintenance, but specialized maintenance personnel perform the maintenance. However, the maintenance personnel can hardly get detailed and correct information on an internal status of the apparatus in the event of trouble from the operator.

In order to solve the problem, there is proposed a cash processing apparatus equipped with a state information logging device which sequentially records the operating states of the sections in the apparatus (for example, see Japanese Patent Laid-Open No. 63-269270). The state information logging device is intended to search the point where the bill is jammed, and the device can specify the jam point by storing output data of a sensor as a log at timing the output state of the sensor is changed.

However, in an embodiment of Japanese Patent Laid-Open No. 63-269270, there is no disclosure concerning the events except for the jam. In addition to the jam, it is necessary that the point, which becomes the cause can be specified after the error such as the number discrepancy, is occurred.

DISCLOSURE OF THE INVENTION

In view of the foregoing, an object of the invention is to provide a bill discriminating and counting apparatus having a logging function, which can trace the cause of the error event including not only the jam but also the number discrepancy.

A bill discriminating and counting apparatus according to as aspect of the invention includes a hopper which receives bills to be processed; a feeding and carrying section which feeds the bills received by said hopper one by one to a transport path and carries the bill; a discriminating and counting section which is provided on a downstream side of said feeding and carrying section, said discriminating and counting section discriminating denominations of the carried bills and counting the bills; a stacker which is provided on the downstream side of said discriminating and counting section and collecting the bills in which normality is confirmed; plural sensors which are provided in said transport path; and plural actuators, wherein said bill discriminating and counting apparatus includes a memory area in which pieces of output signal information on the various sensors and various actuators are sequentially stored, said output signal information being generated in processes of carrying, discriminating, and counting the bill; a registration memory area in which said output signal information associated with an error event is previously registered; and a non-volatile memory which search said registration memory area to specify output signal information associated with a particular error event when the particular error event is occurred, said non-volatile memory loading data from said memory area, the data being stored immediately before the error event concerning the specified output signal information, a set of the data and the error event being stored in the non-volatile memory.

In the bill discriminating and counting apparatus according to the aspect of the invention, preferably the memory area is consisting of a ring memory in which a storage area is circulated.

BRIEF DESCRIPTION OF THE DRAWINGS

FIG. 4A shows a digital data format, and FIG. 4B shows an analog data format;

FIG. 5 shows an example of output pulses of detection sensors, FIG. 5A shows the case where a process is normally performed, and FIG. 5B shows the case where a jam error is occurred;

FIG. 6 is a view showing association between an error event and data to be obtained when the error is occurred; and FIG. 7 shows an example of a logging data format when the error is occurred, FIG. 7A shows a digital data format, and FIG. 7B shows an analog data format.

BEST MODE FOR CARRYING OUT THE INVENTION

In the present invention, pieces of data of states of sensors and actuators in a bill discriminating and counting apparatus are stored in a ring memory at constant time intervals, among these stored data, both the data involved in an error and an error event are stored in a non-volatile memory or a hard disk while associated with each other when the error is occurred in the bill discriminating and counting apparatus, and then the data is read from the non-volatile memory or hard disk to analyze the error. Specifically, digital port input and output information (states of sensors and actuators), analog sensor voltage, and analog motor current value are stored in a memory at constant time intervals since the power is turned on or the counting is started, and the stored port information and voltage are stored in the non-volatile memory or the like along with contents of abnormality when the abnormality is occurred.

Figure 1:
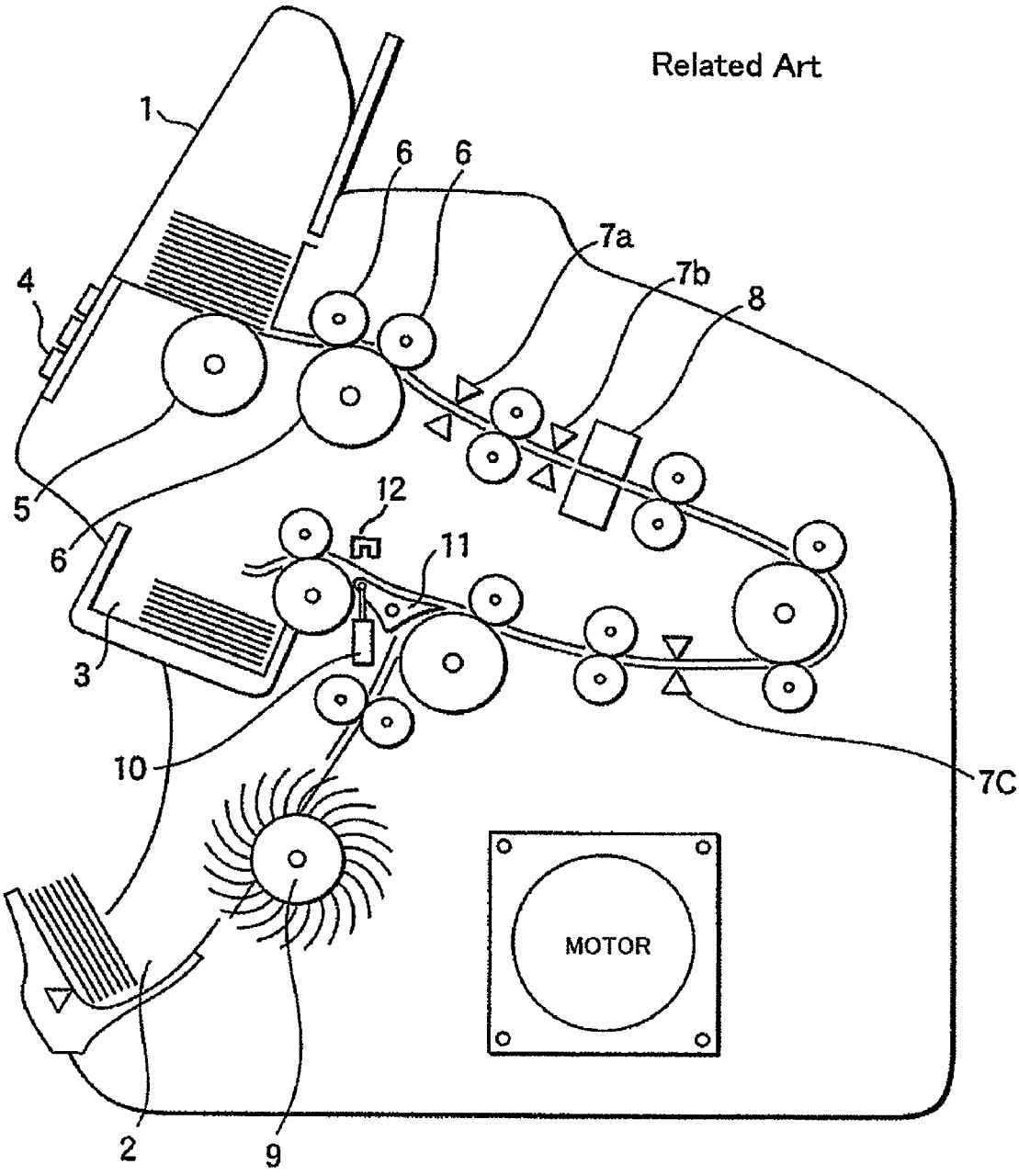
FIG. 1 shows an internal structure of a conventional bill discriminating and counting apparatus.

Examples of the various sensors include a bill detection sensor (located in hopper, feeding and carrying section, inside of transport path, rejection section, and stacker), a line sensor LS (for discriminating denomination), an authenticity discriminating sensor (such as magnetic sensor and ultraviolet sensor), and a branching position detection sensor. The bill detection sensors correspond to detection sensors 7*a*, 7*b*, and 7*c* of FIG. 1. The line sensor LS and the authenticity discriminating sensor correspond to a bill discriminating sensor 8 of FIG. 1.

Examples of the various actuators include a main motor (see FIG. 1), a clutch (not shown), a brake (not shown), a dividing solenoid (corresponding to solenoid 10 of FIG. 1), and fin motor (not shown).

In the following, the bill discriminating and counting apparatus according to the invention will be described in detail with reference to the drawings.

Figure 2:
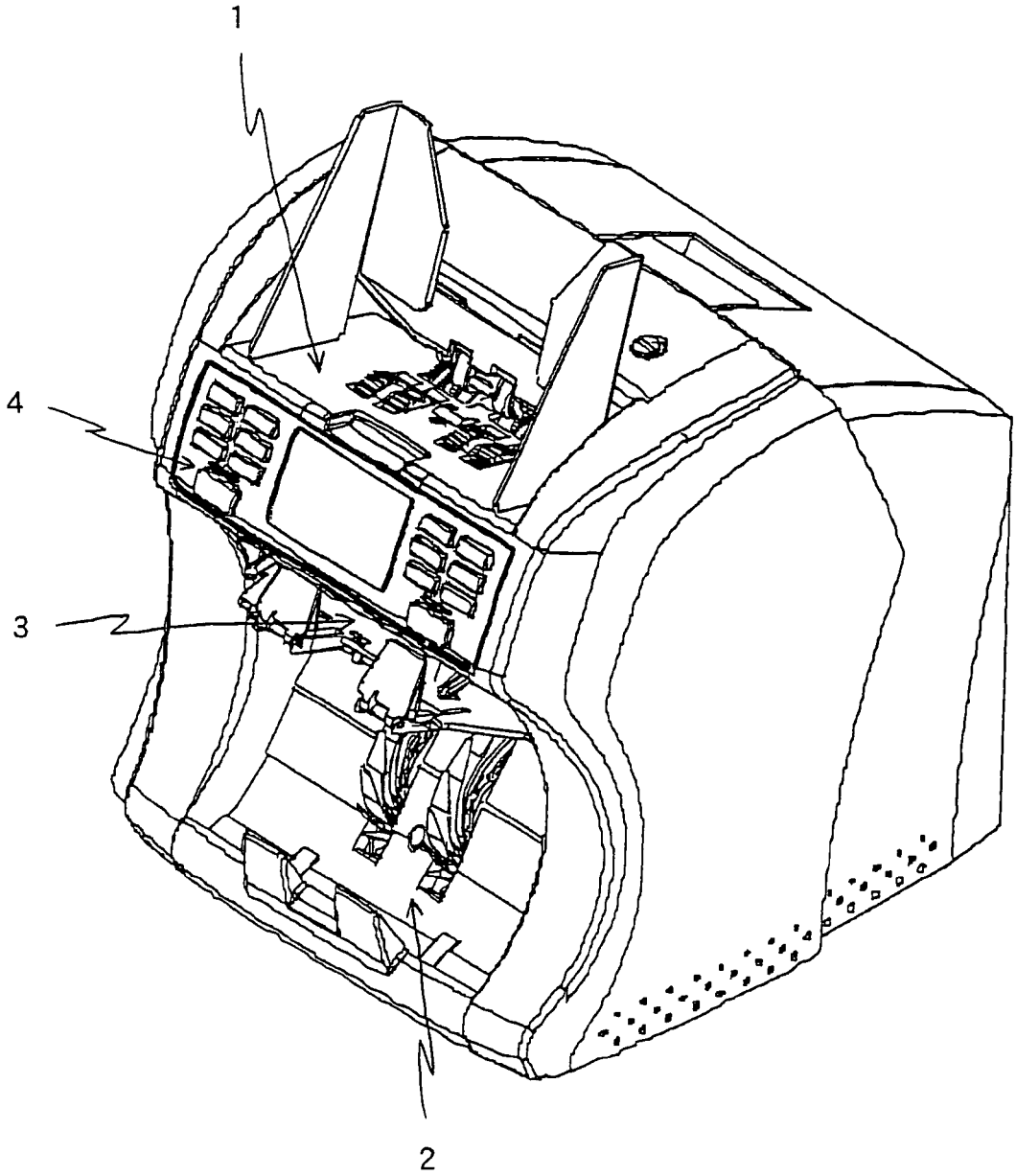
FIG. 2 is a perspective view showing an appearance of a bill discriminating and counting apparatus according to the invention.

FIG. 2 is a perspective view showing an appearance of the bill discriminating and counting apparatus according to the invention.

The bills put in from the hopper 1 are discriminated and counted by the bill discriminating and counting apparatus, and the bills are aligned and collected in the stacker 2. The bill in which the process cannot be performed due to the forged bill or dirt is delivered to the rejection section 3. The operation and display section 4 includes various operation buttons, and an operator provides a necessary instruction by operating the operation and display section 4.

Figure 3:
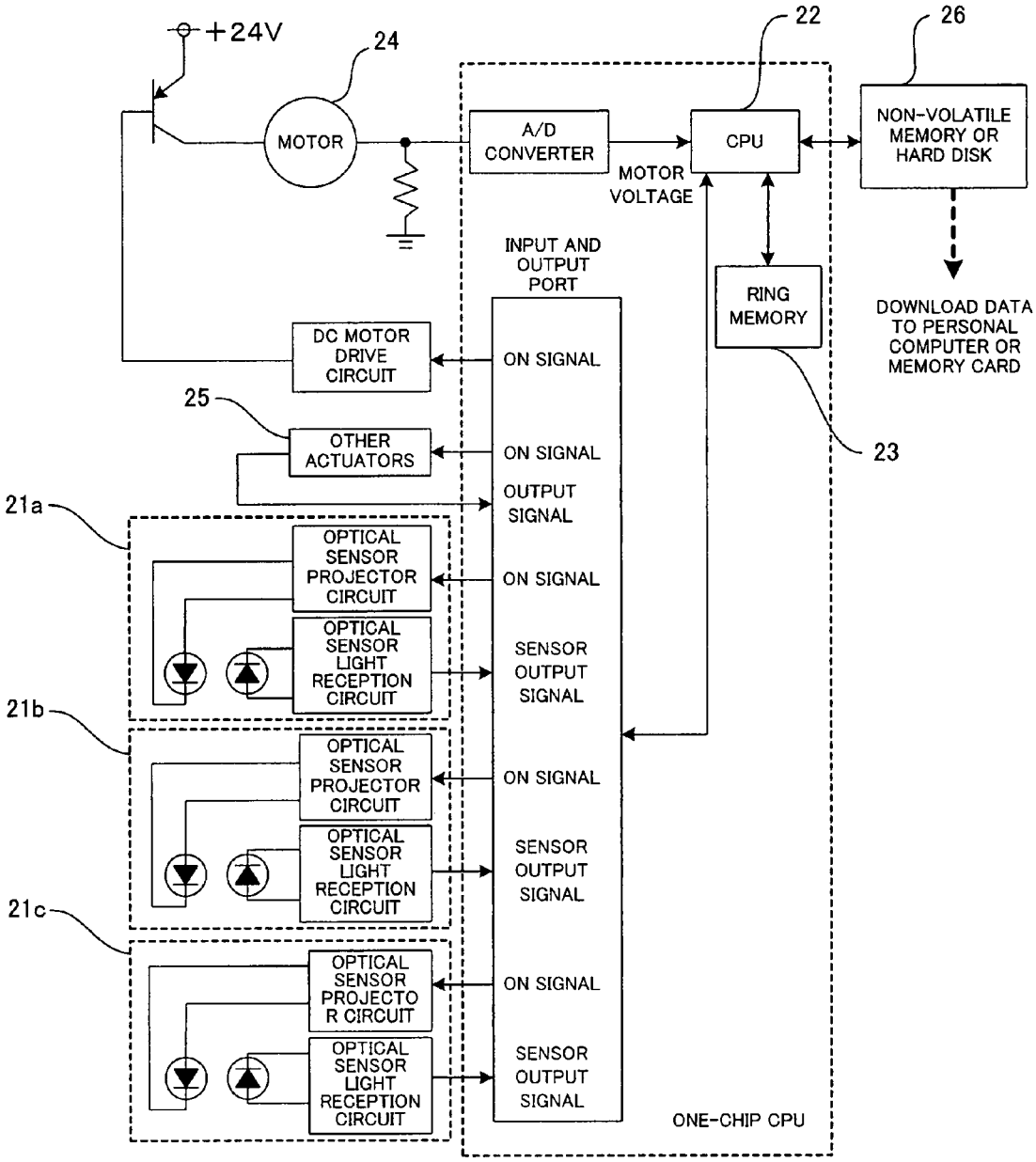
FIG. 3 is a circuit diagram showing an example of a circuit for data logging of the invention.

FIG. 3 is a circuit diagram showing an example of a circuit for data logging of the invention. In FIG. 3, the numerals 21*a* to 21*c* designate bill detection sensors which correspond to the detection sensors 7*a* to 7*c*. The bill detection sensors 21*a* to 21*c* are consisting of an optical sensor, and each pair of the bill detection sensors 21*a* to 21*c* is arrange across the transport path. Drive signals of the bill detection sensors 21*a* to 21*c* are supplied from CPU 22 through an input and output port, and output signals of the bill detection sensors 21*a* to 21*c* are stored in a ring memory 23 from the input and output port through CPU 22 at constant time intervals. An output voltage (analog voltage) of a motor, which is a kind of an actuator, is converted into digital data by an A/D converter, and the digital data is stored in the ring memory 23. Output signals of other actuator 25 (such as dividing solenoid) except for the motor are also stored in the ring memory 23 from the input and output port through CPU 22 at constant time intervals.

Figure 4:
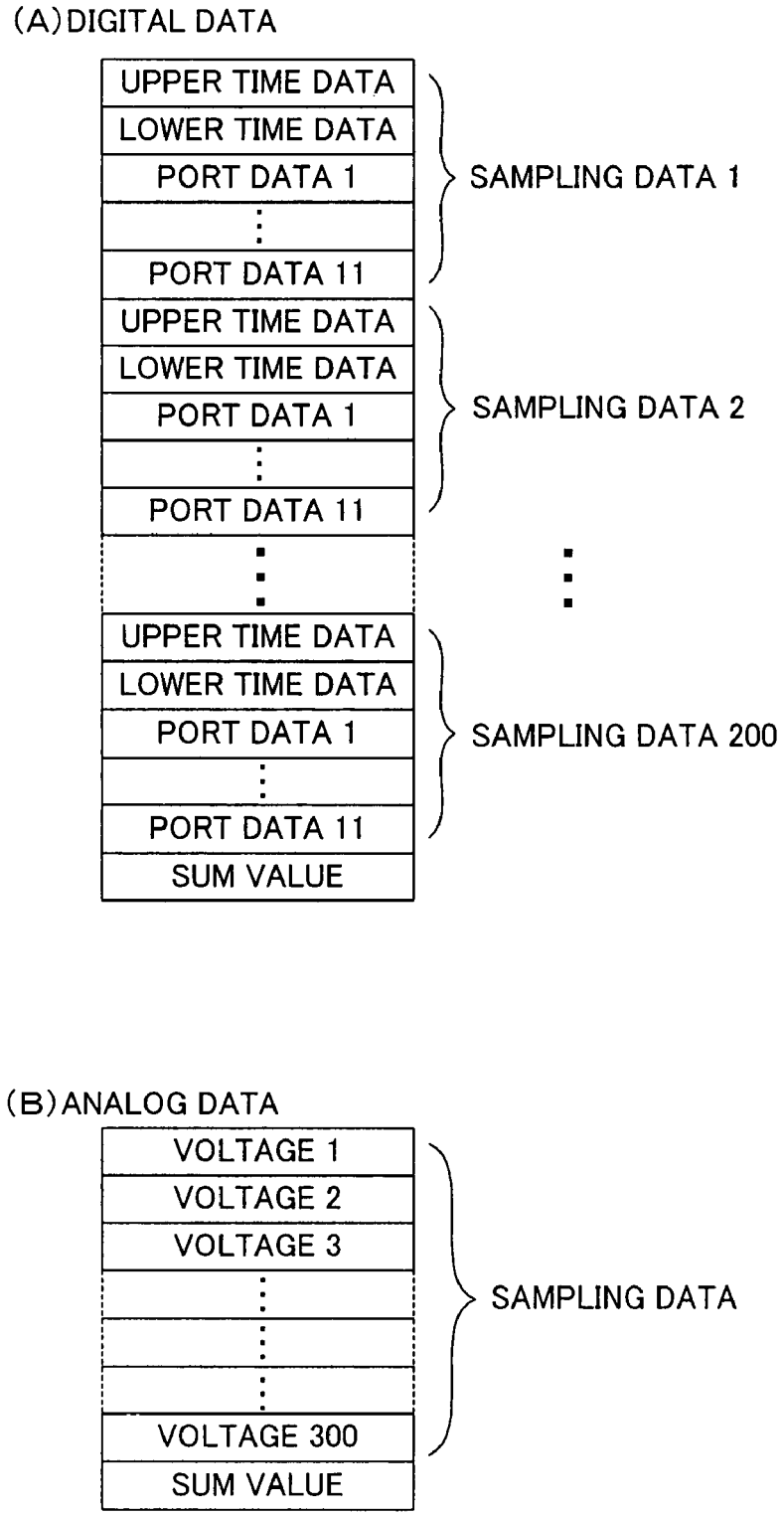
FIG. 4 shows an example of a format of data recorded in a memory of CPU.

FIG. 4 shows an example of a format of data recorded in the ring memory 23 at constant time intervals. The digital data is stored in the ring memory 23 as a set of pieces of data including pieces of time data (upper place and lower place) when the data is obtained and eleven kinds of port data (a total of the eleven kinds of data of seven kinds of sensor output and four kinds of actuator output). In the embodiment, the digital data can be stored up to 200 sets, and the sampling data 1 is overwritten by the 201st sampling data. On the other hand, in the case of the analog data, the data converted by the A/D converter is stored in the ring memory 23 as a voltage value.

FIG. 5 shows the state of output pulses of the bill detection sensors 21*a* to 21*c*. FIG. 5A shows an example of the case where a process is normally performed for the bill, and FIG. 5A shows that the bill detected by the bill detection sensor 21*a* is also normally detected by the sensors 21*b* and 21*c*. On the other hand, in FIG. 5B, the apparatus judges that the jam is occurred, because the sensor 21*b* detects a residence time beyond a predetermined time t (the setting is previously performed such that the apparatus judges that the jam is occurred when the residence time exceeds the time t). However, because the sensor 21*c* normally detects the bill, actually the jam is not occurred in the sensor 21*b*, and this proves to be the fake jam in a later error analysis. This is attributed to the fact that the sensor 21*b* is not normally operated due to the dirty sensor 21*b*.

FIG. 6 is a view showing association between an error event and data to be obtained when the error is occurred. The association of FIG. 6 is registered in a registration memory area (not shown).

For example, when the jam is occurred, potential output information involved in the jam includes output of the bill detection sensor, output of the branching solenoid, output of the branching position detection sensor, and motor current value. Therefore, pieces of information on the ports connected to these output and jam error code (for example, 05-01) are registered while associated with each other.

In the case of the number discrepancy, because only the output of the bill detection sensor is possibly involved in the error event, only the information on the port connected to the output is associated with the error code (for example, 03-01) of the number discrepancy.

According to the above association, when the jam is detected as the error event, the control section (CPU 22) searches the registration memory area to specify the output signal associated with the jam, and the associated output signal at the time immediately before the error is occurred is written in a non-volatile memory 26 along with the error code (jam code 05-01).

FIG. 7 shows an example of a data format when the error is occurred. In the data format of FIG. 7, the data is written in the non-volatile memory or hard disk 26 of FIG. 3 as a set of a data group and the error code. The data group is picked up from the pieces of data of FIG. 4 stored in the memory area immediately before the error occurrence according to the table of FIG. 6.

The data written in the non-volatile memory or hard disk in the format is transferred to a memory card or a hard disk of a personal computer connected to the bill discriminating and counting apparatus, and the operator can take the data to analyze the error in a different location.

In the error analysis, the data recorded in the non-volatile memory or hard disk 26 is read and analyzed.

In the case where the error event is "jam", a group of pieces of data to which the jam error codes (05-01) are given are read from the non-volatile memory 26 to check the pieces of port data and the motor voltage. As a result, it can be known that the jam is the fake jam, when the motor voltage has no abnormality and, at the same time, when the branching solenoid output timing (port 11) and the output (port 7) of the branching position detection sensor 12 have no abnormality and, at the same time, when only the outputs (ports 1 to 6) of the bill detection sensors have abnormality. When the bill is actually jammed in the transport path, the excessive load is applied on the motor, which generates the abnormal motor voltage.

In the case where the error event is "number discrepancy", a group of pieces of data to which the number discrepancy error code (03-01) are given are read from the non-volatile memory 26 to check the pieces of port data. Because only the outputs of the bill detection sensors have the possibility involved in the error event, it is understood which sensor has the abnormality by checking the pieces of port data 1 to 6. Thereby, the sensor to be repaired can be specified.

The invention claimed is:

1. A bill discriminating and counting apparatus comprising:

a hopper which receives bills to be processed;

a feeding and carrying section which feeds the bills received by said hopper one by one to a transport path and carries the bill;

a discriminating and counting section which is provided on a downstream side of said feeding and carrying section, said discriminating and counting section discriminating denominations of the carried bills and counting the bills;

a stacker which is provided on the downstream side of said discriminating and counting section, said stacker collecting the bills in which normality is confirmed;

a plurality of various sensors which are provided in said transport path; and various actuators, wherein said bill discriminating and counting apparatus includes:

a memory area in which pieces of output signal information on said various sensors and said various actuators are sequentially stored, said output signal information being generated in processes of carrying, discriminating, and counting the bill;

a registration memory area in which an association between said output signal information and an error event is previously registered;

a non-volatile memory; and a control section which, when a particular error event occurs, searches said registration memory area to specify output signal information associated with the particular error event, reads data concerning the specified output signal information from the memory area, the data having been stored in the memory area immediately before occurrence of the particular error event, and stores the read data concerning the specified output signal information and a code of the particular error event into the non-volatile memory.

2. A bill discriminating and counting apparatus according to claim 1, wherein said memory area of comprises a ring memory in which a storage area is circulated.

3. A bill discriminating and counting apparatus according to claim 1 or 2, wherein said sensors are bill detection sensors, and said actuators are motors and dividing solenoids.

4. A bill discriminating and counting apparatus according to claim 3, wherein the output signal information registered in with said registration memory area is pieces of output signal information on said bill detection sensor, said motor, and said dividing solenoid when said error event is a jam of the bill.

5. A bill discriminating and counting apparatus according to claim 3, wherein the output signal information registered in said registration memory area is the output signal information on said bill detection sensor when said error event is number discrepancy of the bills.

* * * * *